US010395793B2

(12) United States Patent
Satou et al.

(10) Patent No.: US 10,395,793 B2
(45) Date of Patent: Aug. 27, 2019

(54) CONDUCTIVE MEMBER, TERMINAL-EQUIPPED CONDUCTIVE MEMBER, AND METHOD OF MANUFACTURING CONDUCTIVE MEMBER

(71) Applicant: SUMITOMO WIRING SYSTEMS, LTD., Mie (JP)

(72) Inventors: Osamu Satou, Mie (JP); Jiguo Zheng, Mie (JP); Masamichi Yamagiwa, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 15/772,988

(22) PCT Filed: Oct. 25, 2016

(86) PCT No.: PCT/JP2016/081504
§ 371 (c)(1),
(2) Date: May 2, 2018

(87) PCT Pub. No.: WO2017/082036
PCT Pub. Date: May 18, 2017

(65) Prior Publication Data

US 2018/0322983 A1 Nov. 8, 2018

(30) Foreign Application Priority Data

Nov. 12, 2015 (JP) ..... 2015-221796

(51) Int. Cl.
*H01B 7/00* (2006.01)
*H01B 5/02* (2006.01)
(Continued)

(52) U.S. Cl.
CPC ..... *H01B 5/02* (2013.01); *H01B 1/026* (2013.01); *H01B 13/22* (2013.01); *H01R 4/18* (2013.01);
(Continued)

(58) Field of Classification Search
CPC ..... H01B 1/026; H01B 1/023; H01B 3/02; H01B 3/04; H01B 5/02; H01B 13/22;
(Continued)

(56) References Cited

U.S. PATENT DOCUMENTS 368,765 A * 8/1887 Hammer ..... H01B 7/00
174/74 R
2,806,215 A * 9/1957 Redslob ..... H01R 4/62
174/84 C
(Continued)

FOREIGN PATENT DOCUMENTS

EP 1973200 A1 * 3/2008 ..... H01R 11/12
JP 2011-054374 A * 9/2009 ..... H01B 13/00
(Continued)

OTHER PUBLICATIONS

Official Communication issued in International Bureau of WIPO Patent Application No. PCT/JP2016/081504, dated Jan. 10, 2017.

*Primary Examiner* — William H. Mayo, III
(74) *Attorney, Agent, or Firm* — Greenblum & Bernstein, P.L.C.

(57) ABSTRACT

A terminal is crimped to a portion where a plurality of metal strands are welded. A conductive member is configured by a plurality of coated metal wires provided with a plurality of metal strands and with an electrically conductive sheath covering a circumference of each of the plurality of metal strands. The conductive member includes a welded portion, in which at least a portion in an extension direction of the plurality of coated metal wires is welded, and the welded
(Continued)

portion includes an outer layer that is formed on an outer circumference side by welding the plurality of coated metal wires together, and at least a portion of the plurality of coated metal wires on an inner side of the outer layer is capable of untwining due to crimping a terminal.

9 Claims, 5 Drawing Sheets

(51) Int. Cl.

| | |
|---|---|
| ***H01R 4/18*** | (2006.01) |
| ***H01R 43/048*** | (2006.01) |
| ***H01B 1/02*** | (2006.01) |
| ***H01B 13/22*** | (2006.01) |
| ***H01R 43/02*** | (2006.01) |
| *H01H 1/58* | (2006.01) |

(52) U.S. Cl.
CPC ..... *H01R 43/0207* (2013.01); *H01R 43/048* (2013.01); *H01B 1/023* (2013.01); *H01H 1/5822* (2013.01)

(58) Field of Classification Search
CPC .... H01R 4/18; H01R 43/0207; H01R 43/048; H01H 1/5822
USPC ..... 174/69, 72 A, 73.1, 74 R, 79, 81, 82, 174/84 R, 88 R, 88 S, 84 C
See application file for complete search history.

(56) References Cited

U.S. PATENT DOCUMENTS

| | | | | | |
|---|---|---|---|---|---|
| 2,939,905 | A * | 6/1960 | Canfield | H01B 7/04 | 174/113 C |
| 3,587,030 | A * | 6/1971 | Ohnsorg | H01B 5/12 | 439/502 |
| 3,706,955 | A * | 12/1972 | Bunnell | H01B 7/0009 | 174/126.1 |
| 4,922,072 | A * | 5/1990 | Topel | B23K 11/002 | 219/56.1 |
| 4,973,370 | A * | 11/1990 | Kreinberg | H01R 4/2495 | 156/50 |
| 5,541,380 | A * | 7/1996 | Ogden | H01R 11/12 | 219/56 |
| 9,444,154 | B2 | 9/2016 | Suso | | |
| 2015/0075863 | A1 * | 3/2015 | Suso | H01R 4/021 | 174/75 B |

FOREIGN PATENT DOCUMENTS

| | | |
|---|---|---|
| JP | 2012-064520 | 3/2012 |
| JP | 2013-073877 | 4/2013 |
| JP | 2013-187076 | 9/2013 |
| JP | 2014-011133 | 1/2014 |
| JP | 2014-207108 | 10/2014 |
| JP | 2015-060632 | 3/2015 |
| WO | 2014/168215 | 10/2014 |

* cited by examiner

CONDUCTIVE MEMBER, TERMINAL-EQUIPPED CONDUCTIVE MEMBER, AND METHOD OF MANUFACTURING CONDUCTIVE MEMBER

FIELD OF THE INVENTION

The present invention relates to a conductive member that includes a plurality of metal strands, a terminal-equipped conductive member, and a method of manufacturing a conductive member.

BACKGROUND OF THE INVENTION

In a wire harness mounted in a vehicle such as an automobile, a terminal-equipped wire has a terminal crimped to an end portion of a wire.

In an example given in Patent Literature 1, a terminal-equipped wire is produced using a braided wire as the wire, for example. In Patent Literature 1, an end portion of the braided wire is welded and a swaging portion is created, then a terminal is crimped to the swaging portion.

RELATED ART

Patent Literature

Patent Literature 1: Japanese Patent Laid-open Publication No. 2015-060632

SUMMARY OF THE INVENTION

Problems to be Solved by the Invention

In Patent Literature 1, the swaging portion is formed by welding a plurality of metal strands that configures the braided wire together with resistance welding. In addition, a forefront end surface of the swaging portion is a cut edge face and the edge face is in a fixed state where the forefront ends of the various metal strands do not untwine.

In this example, when each of the metal strands is firmly welded and the swaging portion is too rigid, a terminal is not likely to be crimped adequately to the metal strands.

The present invention seeks to provide a technology that is capable of crimping a terminal adequately to a portion where a plurality of metal strands are welded.

Means for Solving the Problems

A conductive member according to a first aspect is configured by a plurality of coated metal wires provided with a plurality of metal strands and with an electrically conductive sheath covering a circumference of each of the plurality of metal strands, and includes a welded portion, in which at least a portion in an extension direction of the plurality of coated metal wires is welded, and the welded portion includes an outer layer that is formed on an outer circumference side by welding the plurality of coated metal wires together, and at least a portion of the plurality of coated metal wires on an inner side of the outer layer is capable of untwining due to crimping a terminal.

A conductive member according to a second aspect is one mode of the conductive member according to the first aspect. In the conductive member according to the second aspect, at the outer layer, the plurality of metal strands are bonded together by a portion where the sheaths have melted and solidified.

A conductive member according to a third aspect is one mode of the conductive member according to the second aspect. In the conductive member according to the third aspect, the sheath is metal and at the outer layer, the plurality of metal strands having an alloy portion, where the metal strand and the sheath are alloyed, and the sheath formed on an outer circumferential surface of each metal strand are bonded together by a portion where the sheaths have melted and solidified.

A conductive member according to a fourth aspect is one mode of the conductive member according to any one of the first to third aspects. In the conductive member according to the fourth aspect, the metal strand is copper and the sheath is tin plating.

A terminal-equipped conductive member according to a fifth aspect includes the conductive member according to any one of the first to fourth aspects, and a terminal including a crimping portion that is crimped to the welded portion of the conductive member.

A method of manufacturing a conductive member according to a sixth aspect includes a heating step and a pressing step. The heating step is performed by heating a welded portion formation region, which is a region on an extension direction portion of a conductive member configured by a plurality of coated metal wires provided with a plurality of metal strands and with an electrically conductive sheath covering a circumference of each of the plurality of metal strands, from an outer circumference side at a temperature higher than the melting point of the sheaths and lower than the melting point of the metal strands. The pressing step is performed by pressing the heated welded portion formation region from the outer circumference side toward a center.

A method of manufacturing a conductive member according to a seventh aspect is one mode of the method of manufacturing the conductive member according to the sixth aspect. In the method of manufacturing the conductive member according to the seventh aspect, the sheath is metal and the heating step is performed by heating at a temperature higher than the melting point of the sheaths and lower than the melting point of the alloy portions where the sheaths and the metal strands are alloyed.

Effect of the Invention

According to the various aspects noted above, the plurality of coated metal wires are welded together at the outer layer, and therefore, when crimped to the terminal, the coated metal wires are inhibited from protruding from a gap in the crimping portion of the terminal. In addition, at least a portion of the plurality of coated metal wires on the inner side of the outer layer is capable of untwining. In other words, the portion on the inner side of the outer layer is more pliant than the outer layer. Therefore, the welded portion that is crimped to the terminal is easily deformed in response to a shape formed by an inner circumferential surface of the crimping portion after crimping due to the pliant portion on the inner side of the outer layer. As a result, a contact area of the welded portion with the inner circumferential surface of the crimping portion is increased and the terminal can be crimped adequately to the conductive member.

In the second aspect, the plurality of metal strands are bonded together by the portion where the sheaths have melted and then solidified. At this time, each metal strand is likely to maintain its original shape without melting. Therefore, when the sheaths are melted and then solidify, the welded portion is formed while somewhat maintaining its shape due to the metal strand. In other words, the welded portion can be provided easily.

In the third aspect, the sheath is metal and at the outer layer, the plurality of metal strands having the alloy portion, where the metal strand and the sheath are alloyed, and the sheath formed on the outer circumferential surface of each metal strand are bonded together by the portion where the sheaths have melted and solidified. In this example, when the welded portion is formed by heating at the temperature higher than the melting point of the sheaths and lower than the melting point of the alloy portions, for example, the welded portion is formed while somewhat maintaining its original shape due to the metal strands and the alloy portions. In other words, the welded portion can be provided easily.

In the fourth aspect, the metal strand is copper and the sheath is tin plating. In this case, the plurality of metal strands are bonded together by the tin that has melted and then solidified.

In addition, in the terminal-equipped conductive member according to the fifth aspect, the contact area of the welded portion with the inner circumferential surface of the crimping portion is increased and the terminal can be crimped adequately to the conductive member.

In addition, the method of manufacturing the conductive member according to the sixth aspect also allows the contact area of the welded portion with the inner circumferential surface of the crimping portion to be increased and the terminal can be crimped adequately to the conductive member.

Also, in the sixth aspect, heating in the heating step is performed at the temperature higher than the melting point of the sheaths and lower than the melting point of the metal strands. In this case, the metal strand is likely to maintain its original shape without melting. Therefore, when the sheaths are melted and then solidify, the welded portion is formed while somewhat maintaining its shape due to the metal strand. In other words, the welded portion can be provided easily.

Also, in the seventh aspect, heating in the heating step is performed at the temperature higher than the melting point of the sheaths and lower than the melting point of the alloy portions where the sheaths and the metal strands are alloyed. In this case, the welded portion is formed while somewhat maintaining its original shape due to the metal strands and the alloy portions. In other words, the welded portion can be provided easily.

MODE FOR CARRYING OUT THE INVENTION

Figure 1:
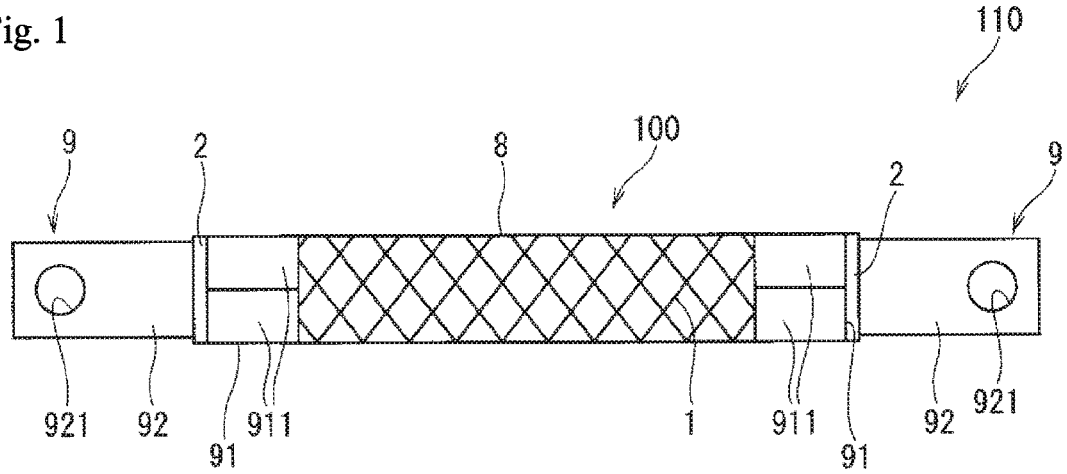
FIG. 1 is a plan view of a terminal-equipped conductive member according to an embodiment.

Hereafter, an embodiment is described with reference to the attached drawings. The embodiment below is presented as an exemplary embodiment of the present invention and shall not be construed as limiting a technical scope of the present invention.

Embodiment

A conductive member 100 and a terminal-equipped conductive member 110 according to the embodiment are described with reference to FIGS. 1 to 5. The conductive member 100 is configured by a plurality of coated metal wires 1. The conductive member 100 also includes a welded portion 2, where the plurality of coated metal wires 1 are welded together. The terminal-equipped conductive member 110 also includes the conductive member 100 and a terminal 9. The conductive member 100 and terminal-equipped conductive member 110 may, for example, be a portion of a wire harness that is mounted in a vehicle such as an automobile.

Figure 2:
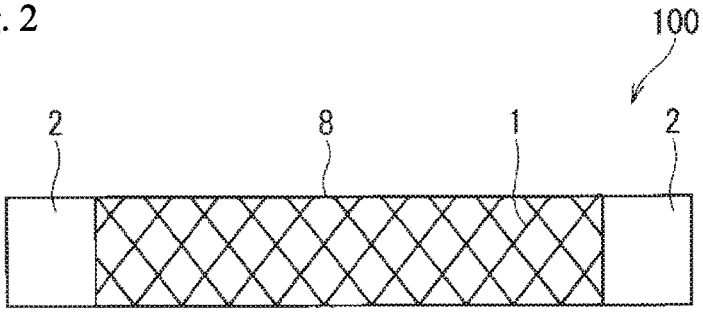
FIG. 2 is a plan view of a conductive member according to the embodiment.
Figure 3:
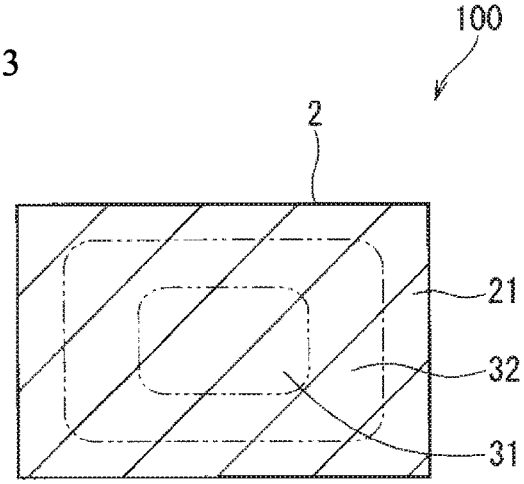
FIG. 3 is a cross-sectional view of a welded portion of the conductive member according to the embodiment.
Figure 4:
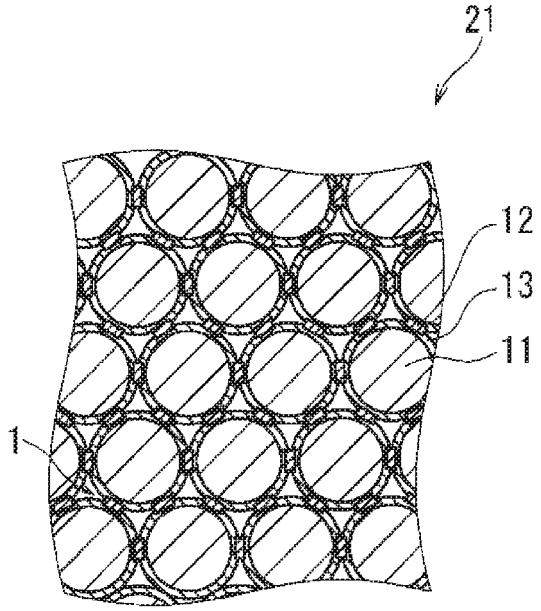
FIG. 4 is a cross-sectional view of an outer layer of the welded portion of the conductive member according to the embodiment.
Figure 5:
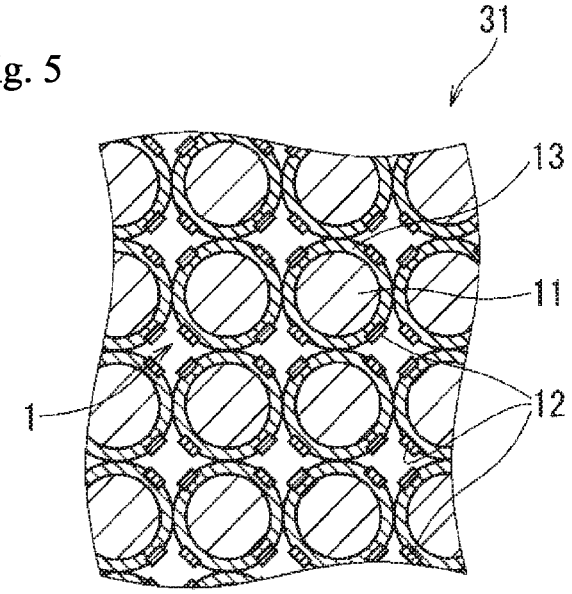
FIG. 5 is a cross-sectional view of an inner layer of the welded portion of the conductive member according to the embodiment.

FIG. 1 is a plan view of the terminal-equipped conductive member 110. FIG. 2 is a plan view of the conductive member 100. FIG. 3 is a cross-sectional view of the welded portion 2 of the conductive member 100. FIG. 4 is an enlarged cross-sectional view of an outer layer 21 on the conductive member 100. FIG. 5 is an enlarged cross-sectional view of an inner layer 31 on the conductive member 100.

First, the conductive member 100 is described. The conductive member 100 is configured by the plurality of metal strands 1. The conductive member 100 is formed so as to be pliant and capable of flexing at portions where the welded portion 2 is not formed.

As illustrated in FIGS. 4 and 5, each of the coated metal wires 1 is provided with a wire-like metal strand 11 and an electrically conductive sheath 12 covering a circumference of the metal strand 11. Here, an example is provided of a case where the sheath 12 is made of metal.

In the present embodiment, an exemplary case is described in which the metal strand 11 is copper and the sheath 12 is tin plating. A case may also be considered in which the metal strand 11 is a metal other than copper and the sheath 12 is not tin plating. Details are described hereafter.

In the present embodiment, the conductive member 100 is further configured by a braided wire in which the plurality of coated metal wires 1 are braided together. Other examples may include the conductive member 100 being configured by twisting together the plurality of coated metal wires 1, for example.

As illustrated in FIGS. 1 and 2, the conductive member 100 includes the welded portion 2, in which at least a portion is welded in an extension direction of the plurality of coated metal wires 1, and a flex portion 8 that is not welded. In this example, the welded portion 2 is formed at each of two ends of the conductive member 100. In addition, the flex portion 8 is formed in a middle region between the welded portions 2 at the two ends. Other examples may include the welded portion 2 being formed at a portion of the middle region of the conductive member 100, for example.

In the present embodiment, the flex portion 8 is a portion that is formed to be pliant and capable of flexing. The flex portion 8 is a portion where the plurality of coated metal wires 1 are not bonded together. Therefore, the plurality of coated metal wires 1 can move in different directions from each other, can move in directions away from each other, and the like at the flex portion 8. In such a case, the conductive member 100 can be pliantly deformed at the flex portion 8.

On the other hand, the welded portion 2 includes the outer layer 21 that is formed on an outer circumferential surface by welding the plurality of coated metal wires 1 together. The welded portion 2 is a portion that is crimped together with the terminal 9, and is more rigid than the flex portion 8. At the welded portion 2, the plurality of coated metal wires 1 that are present on the outer circumference side are welded together. In this example, as described below, the welded portion 2 is formed by pressing the plurality of coated metal wires 1 in a heated state.

At the outer layer 21 of the welded portion 2, the plurality of coated metal wires 1 are bonded together by melting a portion of the respective coated metal wires 1 and the melted portion then solidifying. In this example, the welded portion 2 is formed when heated at a temperature higher than the melting point of the sheath 12 and lower than the melting point of the metal strand 11. More specifically, the welded portion 2 is formed when heated at a temperature higher than the melting point of the sheath 12 and lower than the melting point of an alloy portion 13 where the sheath 12 and the metal strand 11 are alloyed. The alloy portion 13 is a portion in which a portion of the outer circumferential surface of the metal strand 11 is melted and alloyed with the sheath 12. According to the present embodiment, the alloy portion 13 may be formed on the outer circumferential surface of the metal strand 11 when the sheath 12 is welded to the metal strand 11, that is, when the metal strand 11 is plated with the sheath 12. In such a case, the majority of the outer circumferential surface of the metal strand 11 is covered by the alloy portion 13. In addition, the sheath 12 survives in a portion of the outer circumferential surface of the metal strand 11 or in a portion of the outer circumferential surface of the alloy portion 13 that is covering the outer circumferential surface of the metal strand 11. Then, when heated at the temperature higher than the melting point of the sheath 12 and lower than the melting point of the alloy portion 13 where the sheath 12 and the metal strand 11 are alloyed, primarily only the sheath 12 is melted, and the metal strands 11 can be bonded together by a portion where the sheaths 12 have melted and then solidified. In other words, at the outer layer 21, the plurality of metal strands 11 having the alloy portion 13, where the metal strand 11 and the sheath 12 are alloyed, and the sheath 12 formed on the outer circumferential surface of each metal strand 11 are bonded together by the portion where the sheaths 12 have melted and solidified. Further, in the present embodiment, by heating at the temperature lower than the melting point of the alloy portion 13, when the welded portion 2 is formed, excessive melting of the metal strand 11 and the alloy portion 13 can be inhibited. Accordingly, the welded portion 2 can be inhibited from melting to a degree incapable of maintaining its original shape and from becoming excessively rigid when solidified afterwards.

Furthermore, in the present embodiment, the metal strand 11 is copper and the sheath 12 is tin plating. In such a case, the melting point of the metal strand 11 (copper) may be approximately 1085°. In addition, the melting point of the sheath 12 (tin) is approximately 230°. Moreover, the melting point of the alloy portion 13 where the metal strand 11 and the sheath 12 are alloyed may be approximately 400 to 700° (for example, the melting point of $Cu_3Sn$ is around 415°, and the melting point of $Cu_6Sn_5$ is around 676°). Accordingly, in this example, the welded portion 2 may be considered to form when heated to a temperature of 230° to less than 700° (for example, to a temperature of 300°). In such a case, the metal strand 11 is unlikely to melt and somewhat maintains its original shape (that is, wire-like) at the outer layer 21 of the welded portion 2.

Therefore, in this example, as illustrated in FIG. 4, at the outer layer 21, adjacent metal strands 11 are bonded together by the portion where the sheaths 12 have melted and then solidified. More specifically, at the outer layer 21, the majority of the outer circumferential surface of the metal strand 11 is covered by the alloy portion 13 and the metal strands 11 of the adjacent coated metal wires 1 are bonded together by the sheaths 12 surviving on portions of the outer circumferential surface of the metal strand 11.

In addition, at a portion on the outermost circumference side of the outer layer 21 (that is, a portion where the outer circumferential surface of the welded portion 2 is formed), the sheaths 12 are comparatively melted. In this case, a relatively large number of sheaths 12 in liquid form are distributed to the outermost circumference side of the outer layer 21 and solidify, and thereby the metal strands 11 are inhibited from protruding on the outer circumferential surface of the welded portion 2. In this case, after the welded portion 2 is crimped to the terminal 9, the metal strands 11 are inhibited from protruding from a crimping portion 91 of the terminal 9.

In addition, at least a portion of the plurality of coated metal wires 1 on the inner side of the outer layer 21 of the welded portion 2 is capable of untwining due to crimping the terminal 9. In other words, at the inner side of the outer layer 21 of the welded portion 2, the plurality of coated metal wires 1 are formed to be pliant and capable of deforming when crimping to the terminal 9. According to the present embodiment, as shown in FIG. 3, an inner layer 31 and an intermediate portion 32 are formed at the inner side of the outer layer 21 of the welded portion 2.

In the present embodiment, the inner layer 31 is a portion that contains a plurality of the coated metal wires 1 that are not bonded together. In other words, the plurality of coated metal wires 1 contained in the inner layer 31 are capable of untwining. The inner layer 31 is a portion that is more pliant than the outer layer 21.

In this example, all of the coated metal wires 1 contained in the inner layer 31 are capable of untwining. At the inner layer 31, the sheaths 12 do not melt and adjacent metal strands 11 are not bonded together. In other words, as illustrated in FIG. 5, the plurality of coated metal wires 1 are merely in contact with one another. Therefore, at the inner layer 31, the plurality of coated metal wires 1 are likely to deform. In such a case, it is possible to inhibit the welded portion 2 from becoming excessively rigid.

In addition, the intermediate portion 32 is a portion between the outer layer 21 and the inner layer 31, and is a portion that includes both a plurality of coated metal wires 1 that are welded to each other and a plurality of coated metal wires 1 that are not bonded together. Specifically, at the intermediate portion 32, a subset of the plurality of coated metal wires 1 having the coated metal wires 1 welded to each other coexists with a subset having coated metal wires 1 that are capable of untwining. An example may be considered where, for example, at the intermediate portion 32, the portion where the coated metal wires 1 are welded to each other exists toward the outer layer 21 side and the portion where the coated metal wires 1 which are capable of untwining exists toward the inner layer 31 side, and the portions exist such that there is a gradual change from the welded portion over to the portion capable of untwining, the change occurring gradually from the outer layer 21 side toward the inner layer 31 side. In such a case, at the intermediate portion 32, a portion of the coated metal wires 1 can be deformed, and therefore, the intermediate portion 32 can be considered to be a portion that is more pliant than the outer layer 21 and more rigid than the inner layer 31.

Further, as illustrated in FIG. 3, in this example, at the location of the welded portion 2, the conductive member 100 is formed in a rectangular shape in a cross-sectional view as sectioned by a line orthogonal to an extension direction of the conductive member 100. However, the conductive member 100 may have a shape other than the rectangular shape at the location of the welded portion 2, such as a circular, semicircular, or rounded rectangular shape in the cross-sectional view. Moreover, the welded portion 2 of the conductive member 100 is a portion that is crimped together with the terminal 9. In this example, according to the present embodiment, as described below, the welded portion 2 is formed by heating and pressing the plurality of coated metal wires 1. Therefore, the welded portion 2 is considered to have a shape that is readily crimped to the crimping portion 91 of the terminal 9 by being pressed, for example. In addition, in the welded portion 2 which is formed by heating and pressing, the outer circumferential surface of the welded portion 2 is considered to include a curved surface or a smooth flat surface having little unevenness corresponding to a molding surface of a die. In such a case, the state of crimping to the terminal 9 can be considered to become stable.

Next, the terminal-equipped conductive member 110 is described. As illustrated in FIG. 1, the terminal-equipped conductive member 110 includes the conductive member 100, and the terminal 9 having the crimping portion 91 that is crimped to the welded portion 2 of the conductive member 100.

In the present embodiment, the terminal 9 includes the crimping portion 91 and the connection portion 92. The terminal 9 is a member having a metal such as copper as a primary component. The terminal 9 is electrically and mechanically connected to the conductive member 100 by the crimping portion 91.

In this example, the crimping portion 91 includes a pair of crimping tabs 911 that are capable of being crimped onto the welded portion 2 of the conductive member 100. The pair of crimping tabs 911 are portions formed so as to stand upright from a base of the terminal 9 and rise on each of two sides of the welded portion 2.

In the terminal-equipped conductive member 110, the pair of crimping tabs 911 of the crimping portion 91 are swaged in a state where the pair of crimping tabs 911 cover the circumference of the welded portion 2 of the conductive member 100. In this example, as described above, the outer circumferential surface of the welded portion 2 is covered by a portion where the sheath 12 has melted and then solidified, and therefore, the metal strands 11 are not protruding. Therefore, after the welded portion 2 and the crimping portion 91 are crimped, the metal strands 11 of the conductive member 100 are inhibited from protruding between the pair of crimping tabs 911.

In addition, the connection portion 92 is a portion capable of connecting to a mating member that is a connection mate to the terminal 9. In this example, the connection portion 92 is provided with, for example, a fastener hole 921 capable of being fastened by a bolt to a mating member such as a vehicle-side device.

Figure 7:
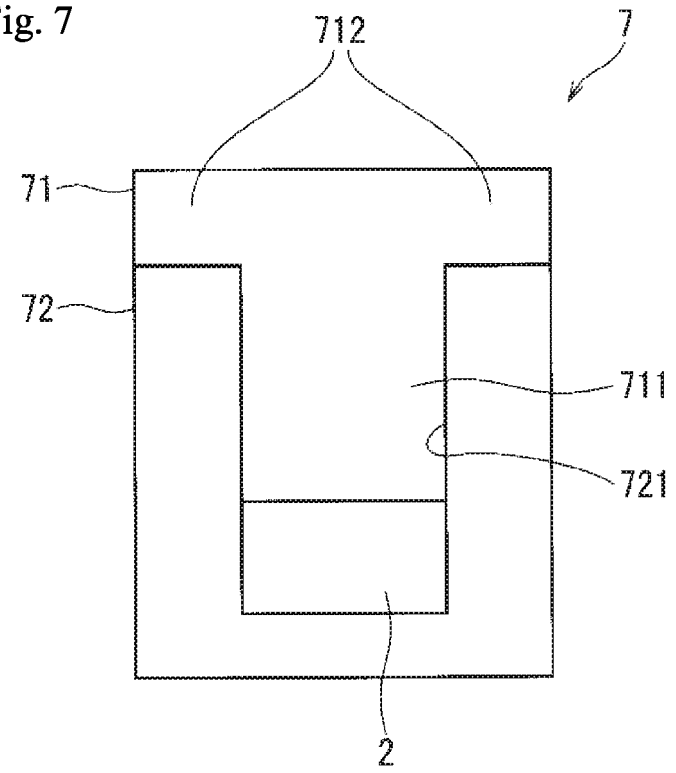
FIG. 7 is an explanatory diagram illustrating the method of manufacturing the conductive member according to the embodiment.
Figure 8:
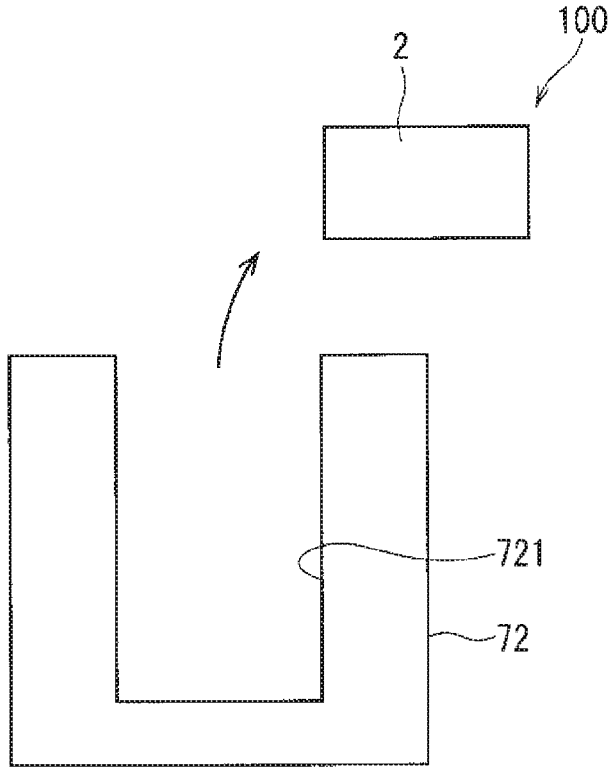
FIG. 8 is an explanatory diagram illustrating the method of manufacturing the conductive member according to the embodiment.

Next, a method of manufacturing a conductive member that manufactures the conductive member 100 is described with reference to FIGS. 6 to 8. The method of manufacturing the conductive member includes a heating step and a pressing step. The heating step is a step where a welded portion formation region 2X, which is a region on an extension direction portion of the conductive member 100 configured by the plurality of coated metal wires 1, is heated from the outer circumferential surface side. Moreover, in this example, as described above, an end portion of the conductive member 100 configured by the plurality of coated metal wires 1 is the welded portion formation region 2X. In the pressing step, by pressing the heated welded portion formation region 2X from the outer circumference side toward a center, while forming the welded portion 2 which includes the outer layer 21 where the plurality of coated metal wires 1 are welded together on the outer circumference side, at least a portion of the plurality of coated metal wires 1 is capable of untwining at the inner side of the outer layer 21.

Further, according to the present embodiment, a die 7 is used in the method of manufacturing the conductive member. The method of manufacturing the conductive member according to the present embodiment includes a first step of setting the welded portion formation region 2X in the die 7; a second step of hot pressing the welded portion formation region 2X using the die 7; and a third step of extracting from the die 7 the conductive member 100 on which the welded portion 2 has been formed. Also, in this example, the second step is a step that includes the heating step and the pressing step described above.

First, the die 7 is described with reference to FIGS. 6 to 8. FIGS. 6 to 8 are explanatory diagrams illustrating the first step, second step, and third step respectively.

In the present embodiment, the die 7 includes a top mold 71 and a bottom mold 72. The top mold 71 and the bottom mold 72 are configured such that one or both can approach and be separated from the other. In addition, in this example, the top mold 71 and the bottom mold 72 are configured to be capable of heating the welded portion formation region 2X. A case can be considered, for example, where a heating device such as a heater is installed in the top mold 71 and the bottom mold 72.

A depression 721 in which the plurality of coated metal wires 1 can be arranged is formed in the bottom mold 72. In addition, the top mold 71 is provided with a projection 711, which can be inserted into the depression 721 of the bottom mold 72. In this example, as illustrated in FIG. 6, the projection 711 of the top mold 71 is inserted into the depression 721 by bringing the projection 711 close to the bottom mold 72 in a state where the projection 711 is opposite the depression 721 of the bottom mold 72. Thereby, the plurality of coated metal wires 1 arranged in the depression 721 are held between the top mold 71 and the bottom mold 72, and pressure is applied to the coated metal wires 1. Moreover, as illustrated in FIG. 7, in this example, the top mold 71 includes a contact portion 712 that, when the projection 711 is inserted into the depression 721 by a predetermined amount, makes contact with a top portion of the depression 721 of the bottom mold 72. In this example, as illustrated in FIGS. 6 and 7, the contact portion 712 projects outward from two sides of the projection 711. The contact portion 712 inhibits the projection 711 of the top mold 71 from being inserted too far into the depression 721 of the bottom mold 72, and inhibits excessive pressure being applied to the plurality of coated metal wires 1.

Hereafter, a detailed description is given of the first step, second step, and third step in the method of manufacturing the conductive member according to the present embodiment.

Figure 6:
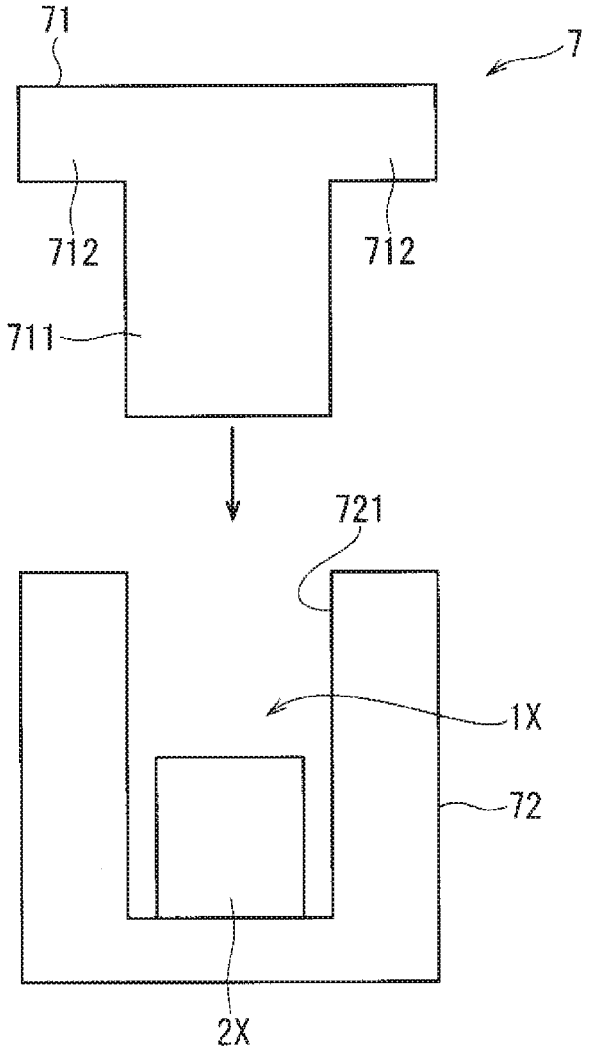
FIG. 6 is an explanatory diagram illustrating a method of manufacturing the conductive member according to the embodiment.

First, in the present embodiment, as illustrated in FIG. 6, in the first step, a braided wire 1X configured by the plurality of coated metal wires 1 is arranged in the depression 721 of the bottom mold 72. In this example, in order to form the welded portion 2 at the end portion of the conductive member 100, an end portion of the braided wire 1X is arranged in the depression 721 of the bottom mold 72. Specifically, in this example, an end portion in the extension direction of the braided wire 1X is the welded portion formation region 2X.

After the first step, the second step is performed. The second step includes a heating step and a pressing step. In the present embodiment, in the second step, the heated top mold 71 and bottom mold 72 each approach each other, or one approaches the other, and the welded portion formation region 2X on the end portion of the braided wire 1X is pressed. Moreover, in this example, the top mold 71 and the bottom mold 72 are pressed against the welded portion formation region 2X from upper and lower directions. For example, the welded portion formation region 2X is pressed by moving the top mold 71 and bottom mold 72 from respective upper and lower sides of the welded portion formation region 2X toward a center of the welded portion formation region 2X. Moreover, the welded portion formation region 2X may be pressed by fixating one of the top mold 71 and the bottom mold 72 and by moving the other toward the center of the welded portion formation region 2X. In addition, as another example, the welded portion formation region 2X may be pressed from left and right directions.

In the present embodiment, the heating step and the pressing step are performed at the same point in time. Moreover, the top mold 71 and the bottom mold 72 are heated at least prior to beginning the second step. For example, a case may be considered in which the top mold 71 and the bottom mold 72 are already heated prior to beginning the first step, or the top mold 71 and the bottom mold 72 are heated beginning partway through the first step.

Also, in the heating step according to the present embodiment, heating is performed at a temperature higher than the melting point of the sheath 12 and lower than the melting point of the metal strand 11. Moreover, in this example, heating is performed at the temperature higher than the melting point of the sheath 12 and lower than the melting point of the alloy portion 13 where the metal strand 11 and the sheath 12 are alloyed. In such a case, the metal strand 11 is unlikely to melt and the pressing step can be performed while the end portion of the braided wire 1X somewhat maintains its original shape. In other words, the welded portion formation region 2X of the end portion of the braided wire 1X can be inhibited from taking on a liquid form. In such a case, workability of the pressing step can be improved.

More specifically, in the heating step of the present embodiment, the surface of the die 7 in contact with the welded portion formation region 2X is heated at a temperature higher than the melting point of the sheath 12 and lower than the melting point of the alloy portion 13 where the metal strand 11 and the sheath 12 are alloyed. Then, by pressing the welded portion formation region 2X at the end portion of the braided wire 1X with the die 7, a state is created on the outer circumference of the welded portion formation region 2X in which the temperature is higher than the melting point of the sheath 12, and a state is created toward the center of the welded portion formation region 2X in which the temperature is lower than the melting point of the sheath 12. For example, a heating temperature and heating time of the die 7, a pressing time for which the welded portion formation region 2X is pressed by the die 7, a pressure applied to the welded portion formation region 2X by the die 7, and the like can be adjusted in view of the number of coated metal wires 1 contained in the welded portion formation region 2X, or the like, in order to achieve such states.

In the present embodiment, a state is created on the outer circumference of the welded portion formation region 2X in which the temperature is higher than the melting point of the sheath 12, enabling primarily the sheath 12 that survives on the outer circumferential surface of the coated metal wires 1 to be melted. Moreover, in the present embodiment, the welded portion formation region 2X is heated at a temperature higher than the melting point of the sheath 12 and lower than the melting point of the alloy portion 13, and therefore the alloy portion 13 of the welded portion formation region 2X is comparatively unlikely to melt, and the welded portion formation region 2X can be inhibited from taking on a liquid form. More specifically, the majority of the outer circumferential surface of the metal strand 11 is covered by the alloy portion 13 and primarily the sheath 12 that survives on the remainder of the outer circumferential surface of the metal strand 11 is melted. Then, the sheath 12 is pressed by the die 7 in a state where the sheath 12 is melted and the surviving sheaths 12 on the outer circumferential surfaces of the adjacent metal strands 11 contact each other and then are solidified, and as illustrated in FIG. 4, the metal strands 11 adjacent to the sheaths 12 are bonded together. In this way, the outer layer 21 on the conductive member 100 is formed.

Meanwhile, at the portion toward the center of the welded portion formation region 2X, heat from the die 7 is not readily transmitted. Therefore, this portion is in a state having a temperature lower than the melting point of the sheath 12. As a result, a state is maintained where the sheath 12 does not melt and the plurality of coated metal wires 1 are untwined. This portion constitutes the inner layer 31 on the conductive member 100.

In addition, a portion between the outer layer 21 and the inner layer 31 can be considered to include a portion where a subset of the plurality of coated metal wires 1 having the coated metal wires 1 welded to each other coexists with a subset having coated metal wires 1 that are capable of untwining. This portion constitutes the intermediate portion 32 on the conductive member 100.

After the second step, the third step is performed. As illustrated in FIG. 8, in the third step, the top mold 71 is separated from the bottom mold 72 and the conductive member 100 is extracted, the conductive member 100 in which the outer layer 21, inner layer 31, and intermediate portion 32 are formed is extracted. Accordingly, the conductive member 100 having the welded portion 2 formed on the end portion thereof can be obtained.

In the present embodiment, the welded portion 2 is formed at each of two ends. Therefore, the first through third steps described above are also performed at the other end. In addition, after the third step is completed, the terminal-equipped conductive member 110 can be obtained by performing a crimping step between the crimping portion 91 of the terminal 9 and the welded portion 2.

Effects According to the present embodiment, in the outer layer 21, the plurality of coated metal wires 1 are welded together, and therefore, when crimped to the terminal 9, the coated metal wires 1 are inhibited from protruding from a gap in the crimping portion 91 of the terminal 9. In addition, at least a portion of the plurality of coated metal wires 1 is capable of untwining at the intermediate portion 32 and the inner layer 31 (inner side of the outer layer 21). In other words, the inner layer 31 and intermediate portion 32 are pliant compared to the outer layer 21. Therefore, the welded portion 2 that is crimped to the terminal 9 is easily deformed in response to a shape formed by an inner circumferential surface of the pair of crimping tabs 911 of the crimping portion 91 of the terminal 9 after crimping due to the pliant inner layer 31 and intermediate portion 32. As a result, a contact area between the welded portion 2 and the inner circumferential surface of the crimping portion 91 of the terminal 9 is increased and the terminal 9 can be crimped adequately to the conductive member 100.

In addition, the outer circumferential surface of the welded portion 2 is configured by a portion where the sheath 12 has melted and then solidified. Therefore, after crimping to the terminal 9, the metal strands 11 are inhibited from protruding from a gap in the pair of crimping tabs 911 of the terminal 9.

In the present embodiment, the plurality of metal strands 11 are bonded together by the portion where the sheaths 12 have melted and then solidified. At this time, the metal strand 11 is likely to maintain its original shape without melting. Therefore, when the sheaths 12 are melted and then solidify, the welded portion 2 is formed while somewhat maintaining its shape due to the metal strand 11. In other words, the welded portion 2 can be provided easily.

In addition, in the present embodiment, the sheath 12 is metal and at the outer layer 21, the plurality of metal strands 11 having the alloy portion 13, where the metal strand 11 and the sheath 12 are alloyed, and the sheath 12 formed on the outer circumferential surface of each metal strand 11 are bonded together by a portion where the sheaths 12 have melted and solidified. Then, the welded portion 2 is formed by heating at a temperature higher than the melting point of the sheath 12 and lower than the melting point of the alloy portion 13. In such a case, the welded portion 2 is formed while somewhat maintaining its original shape due to the metal strand 11 and the alloy portion 13. In other words, the welded portion can be provided easily.

Furthermore, in the present embodiment, the alloy portion 13 where the metal strand 11 and the sheath 12 are alloyed is unlikely to melt, and therefore, at the inner side of the outer layer 21, more coated metal wires 1 are capable of untwining. As a result, the welded portion 2 can be more reliably inhibited from becoming excessively rigid.

In the present embodiment, the metal strand 11 is copper and the sheath 12 is tin plating. In such a case, the plurality of metal strands 11 are bonded together by the tin that has melted and then solidified.

Modifications

Figure 9:
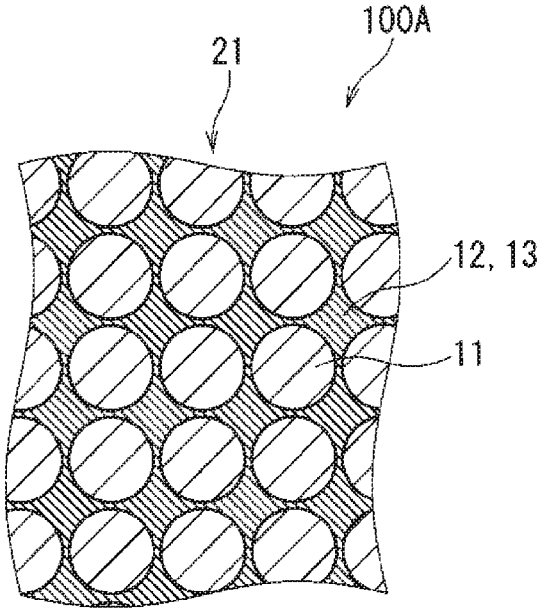
FIG. 9 is a cross-sectional view of an outer layer of a welded portion of a conductive member according to a modification.

A conductive member 100A according to a modification is described with reference to FIG. 9. FIG. 9 is a cross-sectional view of an outer layer 21 of a welded portion 2 of the conductive member 100A. In FIG. 9, the same reference numerals are assigned to components that are identical to those depicted in FIGS. 1 to 8.

In the embodiment, the welded portion 2 is formed when heated at the temperature higher than the melting point of the sheath 12 and lower than the melting point of the alloy portion 13 where the metal strand 11 and the sheath 12 are alloyed. On the other hand, in this example, the welded portion 2 is formed when heated at a temperature higher than the melting point of the alloy portion 13 where the metal strand 11 and the sheath 12 are alloyed and lower than the melting point of the metal strand 11.

As illustrated in FIG. 9, in this example, the plurality of metal strands 11 are bonded together by filling spaces between the plurality of metal strands 11 with a portion where the sheaths 12 and alloy portions 13 have melted and then solidified. In such a case, compared to the welded portion 2 of the conductive member 100 according to the embodiment, the welded portion 2 of the conductive member 100A in this example can be considered to become rigid.

Moreover, also in this example, at least a portion of the plurality of coated metal wires 1 on the inner side of the outer layer 21 is capable of untwining. This is because, at the inner side of the outer layer 21, heat is hardly transmitted and a state is maintained where the sheath 12 and the alloy portion 13 do not melt and the plurality of coated metal wires 1 are untwined. Therefore, also in this example, similar to the embodiment, the terminal 9 can be crimped adequately to the conductive member 100.

Exemplary Applications

In addition, at a portion where the welded portion 2 of the conductive member 100 is welded, cases may be considered where only the outer layer 21 and intermediate portion 32 are formed or only the outer layer 21 and inner layer 31 are formed.

An example may also be considered for the coated metal wire 1 where, when the metal strand 11 is copper, the sheath 12 is nickel plating, silver plating, or the like.

Another example may also be considered for the coated metal wire 1 where the metal strand 11 is a metal other than copper. For example, the metal strand 11 may be a metal principally composed of aluminum. In such a case, an example may be considered where the sheath 12 is zinc plating, tin plating, or the like.

The conductive member, the terminal-equipped conductive member, and the method of manufacturing the conductive member according to the present invention can also be configured by freely combining the embodiments, modifications, and exemplary applications given above, or by appropriately modifying or omitting portions of the embodiments, modifications, and exemplary applications, within the scope of the invention established in each of the claims.

DESCRIPTION OF REFERENCE NUMERALS

1 Coated metal wire
100 Conductive member
11 Metal strand
110 Terminal-equipped conductive member
12 Sheath
13 Alloy portion
2 Welded portion
21 Outer layer
2X Welded portion formation region
31 Inner layer
32 Intermediate portion
9 Terminal
91 Crimping portion

The invention claimed is:

1. A conductive member configured by a plurality of coated metal wires provided with a plurality of metal strands and with an electrically conductive sheath covering a circumference of each of the plurality of metal strands, the conductive member comprising:

a welded portion, in which at least a portion in an extension direction of the plurality of coated metal wires is welded, wherein the welded portion includes an outer layer that is formed on an outer circumference side by welding the plurality of coated metal wires together, and an inner layer, the outer layer including an outermost circumference side having a majority of the coated metal wires welded together, and an inner side having at least a portion of the plurality of coated metal wires capable of untwining due to crimping a terminal, and the inner layer provided at the inner side of the outer layer, the inner layer containing a plurality of the coated metal wires not welded together and capable of untwining due to crimping a terminal.

2. The conductive member according to claim 1, wherein in the outer layer, the plurality of metal strands are bonded together by a portion where the sheaths have melted and solidified.

3. The conductive member according to claim 2, wherein the sheaths are metal, and in the outer layer, the plurality of metal strands have an alloy portion, where the metal strand and the sheath are alloyed, and the sheath formed on an outer circumferential surface of each metal strand are bonded together by a portion where the sheaths have melted and solidified.

4. The conductive member according to claim 1, wherein the metal strands are copper, and the sheaths are tin plating.

5. A terminal-equipped conductive member comprising:

the conductive member according to claim 1; and a terminal including a crimping portion that is crimped to the welded portion of the conductive member.

6. The conductive member according to claim 1, the welded portion further comprising an intermediate portion between the outer layer and inner layer, the intermediate portion including both a plurality of coated metal wires that are welded to each other and a plurality of coated wires that are not welded to each other.

7. A method of manufacturing a conductive member comprising:

heating from an outer circumference side a welded portion formation region, which is a region on an extension direction portion of a conductive member configured by a plurality of coated metal wires provided with a plurality of metal strands and an electrically conductive sheath covering a circumference of each of the plurality of metal strands, at a temperature higher than the melting point of the sheaths and lower than the melting point of the metal strands, and pressing the heated welded portion formation region from the outer circumference side toward a center, the heating and pressing forming a welded portion including an outer layer that is formed on an outer circumference side by welding the plurality of coated metal wires together, and an inner layer, the outer layer including an outermost circumference side having a majority of the coated metal wires welded together, and an inner side having at least a portion of the plurality of coated metal wires capable of untwining due to crimping a terminal, and the inner layer provided at the inner side of the outer layer, the inner layer containing a plurality of the coated metal wires not welded together and capable of untwining due to crimping a terminal.

8. The method of manufacturing the conductive member according to claim 7, wherein the sheaths are metal, and the heating is performed at a temperature higher than the melting point of the sheaths and lower than the melting point of alloy portions where the sheaths and the metal strands are alloyed.

9. The method of manufacturing the conductive member according to claim 7, wherein forming the welded portion further comprises forming an intermediate portion between the outer layer and inner layer, the intermediate portion including both a plurality of coated metal wires that are welded to each other and a plurality of coated wires that are not welded to each other.

* * * * *